US007374481B2

(12) United States Patent
Rehkemper et al.

(10) Patent No.: US 7,374,481 B2
(45) Date of Patent: May 20, 2008

(54) ROTATING PATTERN MATCHING BOARD GAME

(75) Inventors: Steven Rehkemper, Chicago, IL (US); Jeffrey Rehkemper, Chicago, IL (US)

(73) Assignee: Rehco, LLC, Chicago, IL (US)

( * ) Notice: Subject to any disclaimer, the term of this patent is extended or adjusted under 35 U.S.C. 154(b) by 593 days.

(21) Appl. No.: 10/825,055

(22) Filed: Apr. 16, 2004

(65) Prior Publication Data

US 2005/0233792 A1 Oct. 20, 2005

(51) Int. Cl.

| | |
|---|---|
| ***A63F 9/24*** | (2006.01) |
| ***A63F 13/00*** | (2006.01) |
| ***G06F 17/00*** | (2006.01) |
| ***G06F 19/00*** | (2006.01) |

(52) U.S. Cl. ..... 463/9; 463/16; 463/35; 463/37; 273/143 R; 273/143 A; 273/430; 273/432; 446/175; 446/236; 446/242; 446/265; 446/491

(58) Field of Classification Search ..... 463/9, 463/16, 35, 37; 273/142 R, 143 A, 430, 273/432; 446/175, 236, 242, 265, 491
See application file for complete search history.

(56) References Cited

U.S. PATENT DOCUMENTS 4,207,087 A * 6/1980 Morrison et al. ..... 463/9
4,310,156 A * 1/1982 Kulesza et al. ..... 273/447
4,346,893 A * 8/1982 Landsinger et al. ... 273/108.56
4,689,604 A * 8/1987 Sokol ..... 345/31
5,279,672 A * 1/1994 Betker et al. ..... 134/18
5,855,513 A * 1/1999 Lam ..... 463/9
5,887,872 A * 3/1999 Keifer et al. ..... 273/273
6,856,303 B2 * 2/2005 Kowalewski ..... 345/31

* cited by examiner

*Primary Examiner*—Xuan M. Thai
*Assistant Examiner*—Jason Pinheiro

(57) ABSTRACT

A sequencing game is provided with a housing and a microprocessor disposed within the housing. A plurality of manually operable controls are affixed to the housing and are in communication with the microprocessor. The microprocessor generates and sensorially renders a sequence of events, wherein each event is related to one of the manually operable controls. Each manually operable control is externally acutable by a participant for responding to said sequence of signals. The microprocessor further compares the participant's response to said sequence of events for determining the correctness of the participant's response. The difficultly of the game is increased with a motor that drives wheels which move the game while the sequence of events are being sensorially rendered.

16 Claims, 2 Drawing Sheets

ROTATING PATTERN MATCHING BOARD GAME

FIELD OF THE INVENTION

The present invention relates generally to games and, more particularly, to a rotating pattern matching board game.

BACKGROUND OF THE INVENTION

Electronic tone, light, and music producing games are known. Such games automatically sequence through a plurality of events (such as tones or lights, or both). Upon which the game participants must recreate the plurality of events by hitting various buttons or switches on the device. When the participants matches the identical pattern or sequence, the game may continue by increasing the difficultly of the game. The difficultly of the game may be increased by decreasing the interval between events or increases the number of events the user must match.

One such game is described in U.S. Pat. No. 4,207,087 to Morrison et al. and is directed to the well known pattern matching game "SIMON" that Is manufactured by Milton Bradley. The '087 patent is directed to a game that includes a plurality of push-button switches, each associated with a tone or light, or both. The device generates a sequence of tones and lights associated with different push-button switches on the game. The generated sequence of events must be repeated by a participant by depressing the proper push-button switches. If the participant correctly repeats the sequence, the machine adds another entry to the sequence and plays the lengthened sequence which must again be repeated by the participant. This process may be repeated until a predetermined lengthened sequence is met or the participant makes an error.

In another game described in U.S. Pat. No. 5,009,419, the game has a first participant enter in a sequence which must be followed by a second participant. In addition the game can generate a sequence of tones or lights that rotate in a clockwise or counter clockwise rotation around the game board. However, the game itself is a stationary game and does not move.

Other pattern matting or sequence matching board games may be found in U.S. Pat. Nos. 5,855,513 and 4,363,482. However, none of these patents call for a moving board game that requires a participant to match the generated sequence of tones, lights, or music.

SUMMARY OF THE INVENTION

In accordance with one embodiment of the present invention a sequencing game is provided. The game includes a housing unit and a microprocessor disposed within the housing for controlling the game. The housing has a plurality of push buttons affixed thereto, each of which are in communication with the microprocessor. The push buttons are actuated externally from the housing by a participant during game play. Under each push button is a light emitting source that is controlled by the microprocessor to illuminate a specific push button. In addition, the housing has a speaker that is controlled by the microprocessor to emit a plurality of tones, each tone is preferably associated to a specific push button. The housing further includes a plurality of wheels that are operated by the microprocessor such that the entire game when placed on a surface moves during game play.

During game play the microprocessor creates a sequence of events that a participant tries to match. The sequence of events may include the illumination of a number of push buttons in any specific order and rendering unique tones or sounds simultaneously with the illumination of a push button to assist the user in identifying which push button was illuminated. In addition the housing rotates or moves to add a level of difficulty to the game. After the sequence of events is rendered, the participant attempts to match the sequence of operating the push buttons in the same order (again while the housing is rotating or moving). Moreover, the rate of rotating of the housing or the direction of the rotation may automatically change during game play to increase or decrease the difficultly.

The participant's response is then compared to the rendered sequence of events. If the participant's response is correct the game may add an event to the sequence and than render the new sequence. If the participant's response is wrong, the game may end with a specific tone or sound indicating to the participant that they were wrong.

Numerous other advantages and features of the invention will become readily apparent from the following detailed description of the invention and the embodiments thereof, from the claims, and from the accompanying drawings.

BRIEF DESCRIPTION OF THE DRAWINGS

A fuller understanding of the foregoing may be had by reference to the accompanying drawings, wherein:

FIG. 1 is a perspective view of a rotational pattern matching game board illustrating the components seen there-through.

DETAILED DESCRIPTION OF THE EMBODIMENTS

Figure 1:
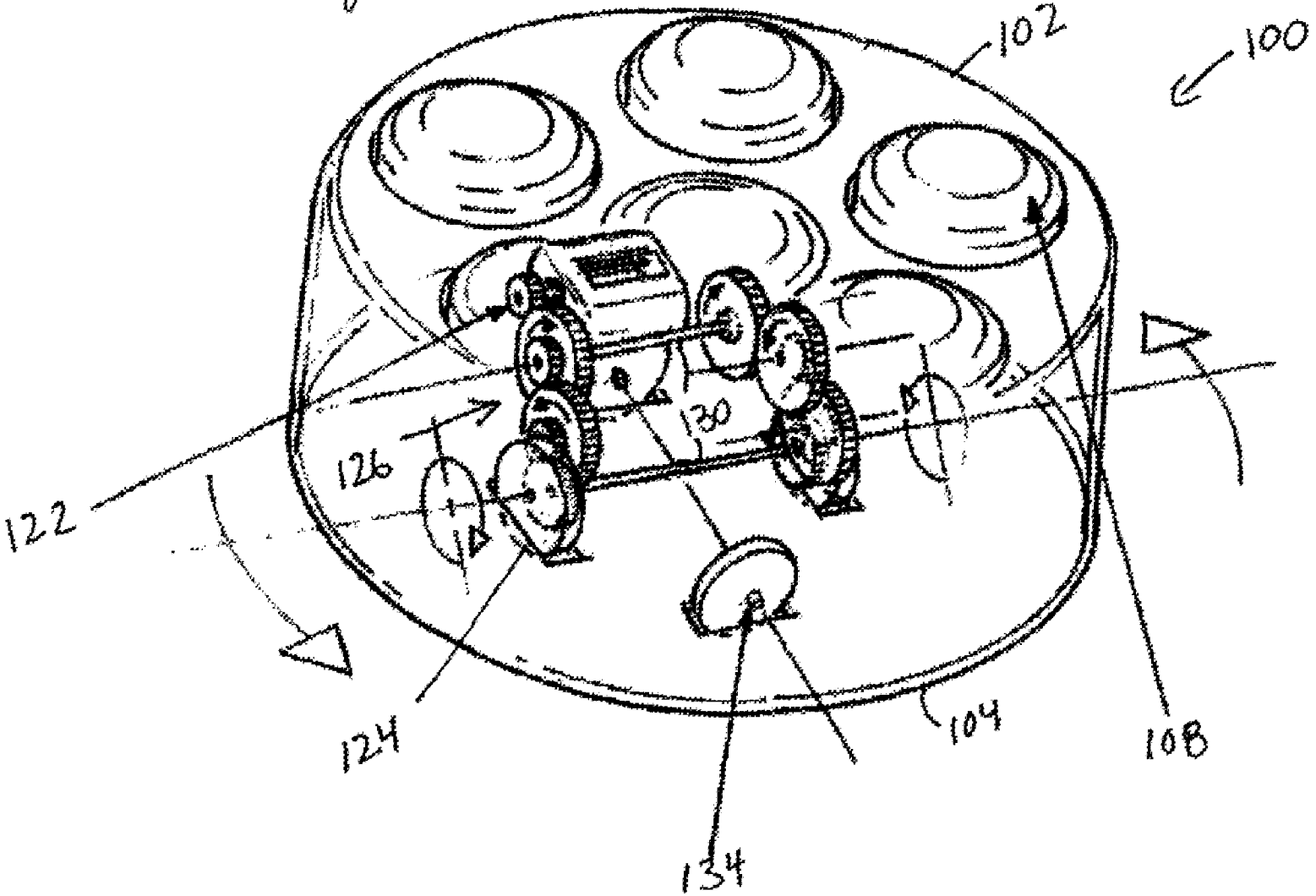

While the invention is susceptible to embodiments in many different forms, there are shown in the drawings and will be described herein, in detail, the preferred embodiments of the present invention. It should be understood, however, that the present disclosure is to be considered an exemplification of the principles of the invention and is not intended to limit the spirit or scope of the invention and/or claims of the embodiments illustrated.

Figure 2:
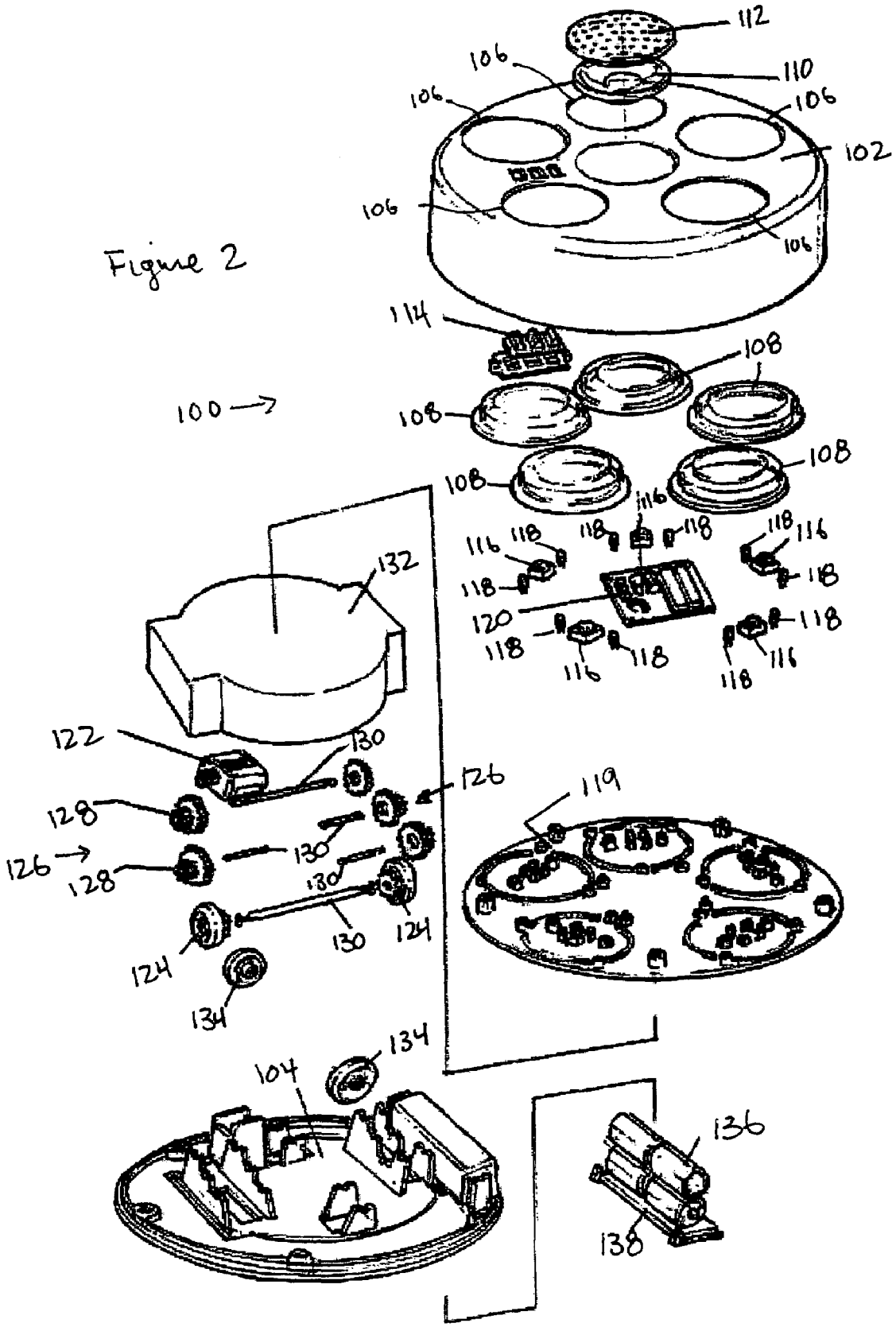
FIG. 2 is an exploded view of the game board in FIG. 1.

Referring now to FIG. 1 and FIG. 2, there is illustrated a sequencing game board 100 that includes a top housing section 102 that assembles or connects to a bottom housing section 104. The top housing section 102 has a plurality of openings 106 for receiving a equal number of manually operable controls or push buttons 108. The top housing section 102 also includes openings for a speaker 110 and speaker cover 112, and an activation or control button array 114.

Each push button 108 has associated therewith a switch 116 and a light emitting source(s) or diode(s) 118. To help differentiate the push buttons from each other, different colored push buttons or different colored light sources may be incorporated. The push buttons 108, switches 116, light sources 118, and speaker 110 rest upon a retaining plate 119 and are all operable or controlled by a microprocessor 120.

The microprocessor 120 also controls a motor mechanism 122 that drives at least one wheel 124 through a gear train 126 (which includes various gears 128 and operable axles 130. Preferably, the motor mechanism 122 drives a pair of wheels 124 in opposite directions, such that the entire game rotates about a center axis. The motor mechanism 122 is also controlled to rotate the wheels in a reverse direction such that the direction of the rotation of the game may change throughout the game. In addition, the motor mechanism 122 may be controlled to increase or decrease the rate of rotation. A pair of freely rotating wheels 134 are positioned perpendicularly to the rotating wheels 124 to provide stability to the game 100. The motor mechanism 122, the wheels 124 and 134, and the gear train 126 are secured against the bottom housing section 104 within a gear box 132. The top portion defined by the gear box 132 is secured to the bottom portion of the retaining plate 119.

Power to the game 100 is provided through a battery pack 136 that is removably through an external battery door 138. The battery door 138 is attached to the underside of the bottom housing section 104.

When the game is activated, through one of the activation buttons on the control button array 114, the microprocessor 120 generates a sensorially sequences of events categorized by illuminating the push buttons and/or emitting aurally sounds and tones from the speaker. The sequence of events typically begins with a single event, but builds upon itself as the participants progresses into the more difficult stages (discussed in greater detail below). In addition, the microprocessor 120 also moves the game 100 by rotating the game about its center axis. This is accomplished by spinning the two operable wheels 124. It is appreciated that while the game rotates about its center axis, the motor mechanism, gear train and wheels can be easily configured to move the game in a forward, backwards, and/or sideways direction.

After the microprocessor 120 renders the sequence of events, meaning the push buttons are illuminated and/or the tones are emitted, the participant attempts to match the sequence by pressing the push buttons in the identical order in which they were just illuminated. As each push button 108 is pressed (triggering the switch 116 thereunder) the microprocessor will check the participant's response against the stored sequence of events. This can be accomplished by storing participant's entire response and then checking it against the stored sequence of events or preferably by comparing the participant's response as it is being entered against the correct sequence. In the preferred manner, the microprocessor would be capable of determining the wrong response by the participant immediately, and in such instances the microprocessor would indicate a wrong response by emitting sounds and tones that the participant would understand as being incorrect response.

If, however, the participant's response was correct or corresponded to the last rendered sequence of events, the microprocessor would generate a new sequence of events by increasing the number of events. The difficultly of the game could also be increased by increasing the rate of rotation, changing the direction of the rotation, and/or decreasing a time interval between each event, in the sequence of events (which can be accomplished by incorporating a timing circuit into the microprocessor). This could continue until the number of events reached a predetermined number, at which point if the participant's response was correct the game could emit sounds and illuminate the push buttons to indicate to the participant that they have won.

The control button array 114 is used to change playing levels or difficulties of the game. In addition, the control button array 114 could be used to adjust the volume of the sounds and tones, as well as turn the game on and off.

From the foregoing and as mentioned above, it will be observed that numerous variations and modifications may be effected without departing from the spirit and scope of the novel concept of the invention. It is to be understood that no limitation with respect to the specific methods and apparatus illustrated herein is intended or should be inferred. It is, of course, intended to cover by the appended claims all such modifications as fall within the scope of the claims.

We claim:

1. A sequencing game comprising:

a housing;

a microprocessor disposed within said housing;

a plurality of manually operable controls affixed to said housing and in communication with said microprocessor;

the microprocessor having a means for generating and sensorially rendering a sequence of events, wherein each event in the sequence of events is related to one manually operable control of the plurality of manually operable controls;

each manually operable control of said plurality of manually operable controls is capable of being actuated externally from said housing by a participant as a response to said sequence of events, wherein said response by said participant is compared by the microprocessor to said sequence of events for determining a correctness of the response; and a mechanical means to rotate said housing while the sequence of events are being sensorially rendered, wherein said microprocessor further includes programming to control the mechanical means for changing a rate of rotation and/or a direction of the rotation based on the correctness of the response to the sequence of events generated by said microprocessor.

2. The game of claim 1, wherein the mechanical means to rotate said housing includes a motor mechanism and a plurality of wheels secured to a lower portion defined by said housing and at least one of said plurality of wheels being rotatably controlled by said motor mechanism.

3. The game of claim 1 further comprising means for providing a first indication when said response corresponds to the sensorially rendered sequence of events which includes replaying the sequence of events and generating and rendering a new event after the sequence of events.

4. The game of claim 1 further comprising means for providing a second indication when said response does not correspond to the sensorially rendered sequence of events which includes generating and rendering a sensorially error event.

5. The game of claim 1, wherein said generation of said sequence of events includes generating a plurality of distinct visually perceptible light indications.

6. The game of claim 1, wherein said generation of said sequence of events includes generating a plurality of distinct aurally perceptible tones.

7. The game of claim 1, wherein said plurality of manually operable controls includes a plurality of push buttons.

8. The game of claim 1, wherein the mechanical means is controlled to move said housing while the participant is making a response.

9. A sequencing game having a housing and a microprocessor disposed within said housing, the game comprising:

a plurality of different colored push buttons affixed to said housing and in communication with said microprocessor, each push button of said plurality of push buttons is operable by a participant from outside said housing and includes a light emitting source affixed to the housing under said push button, each light emitting source is also controllable by said microprocessor to illuminate said push button;

means for generating a sequence of events and rendering said sequence of events by operating said lights under said plurality of push buttons and means within said microprocessor for storing said sequence of events, wherein each event of the sequence of events corresponds to one of the push buttons, of the plurality of push buttons;

a motor in communication with a plurality of wheels to rotate the housing;

said motor being controlled by said microprocessor to move said housing while said sequence of events are being rendered and during participant's response; and each push button when actuated externally from said housing by the participant generates a response to said sequence of events, wherein said response by said participant is compared by the microprocessor to said sequence of events for determining a correctness of the response, wherein said microprocessor includes programming to control a rate of rotation and/or a direction of the rotation based on the correctness of the response to said generated sequence of events.

10. The game of claim 9, wherein the plurality of wheels include two wheels being operable by the motor in opposite directions to each other, such that the housing rotates at a predetermined rate of rotation in a predetermined direction.

11. The game of claim 10 further comprising: a means within said microprocessor for adding events to said sequence of events and rendering said sequence of events with the added events only when the response corresponds to the sequence of events last rendered by said microprocessor.

12. The game of claim 11 further comprising: a means within said microprocessor for generating an error signal when said response does not correspond to the sequence of events last rendered by said microprocessor.

13. The game of claim 11 further comprising: a means within said microprocessor for generating an error signal when said response is not made within a predetermined time.

14. The game of claim 11 further comprising: a means within said microprocessor for increasing a rate of rotation of said housing when the response corresponds to the sequence of events lasted rendered by said microprocessor.

15. The game of claim 11 further comprising: a means within said microprocessor for changing the predetermined direction of the rotating of the housing.

16. The game of claim 9 further comprising a speaker affixed to the housing and controlled by the microprocessor such that the microprocessor emits a plurality of distinct aurally perceptible tones, each tone of said plurality of distinct aurally perceptible tones corresponds to a push button.

* * * * *